United States Patent [19]

Marhal

[11] Patent Number: 4,577,753

[45] Date of Patent: Mar. 25, 1986

[54] SEALED MESSAGE CARRIER

[76] Inventor: Joseph Marhal, 3567 E. Fitzsimmons Rd., Oak Creek, Wis. 53154

[21] Appl. No.: 654,894

[22] Filed: Sep. 27, 1984

[51] Int. Cl.[4] ..... B65D 85/46

[52] U.S. Cl. ..... 206/232; 206/38; 215/6; 446/75

[58] Field of Search ..... 206/38, 45.33, 45.34, 206/232, 457; 215/1 R, 6, 366; 446/75, 268, 369; 273/161; D7/42/75

[56] References Cited

U.S. PATENT DOCUMENTS

| | | | |
|---|---|---|---|
| 1,223,933 | 4/1917 | Carr | D7/42 |
| 1,577,374 | 3/1926 | Shelley | 215/1 R |
| 1,728,883 | 9/1929 | Simon | 215/6 |
| 1,841,266 | 1/1932 | Jones | 206/232 |
| 1,856,619 | 5/1932 | Carsey | 206/232 |
| 2,113,715 | 4/1938 | Wilcox | 206/232 |
| 2,498,074 | 2/1950 | Feldman | 206/45.34 |
| 3,256,978 | 6/1966 | Srigley et al. | 206/232 |
| 3,374,911 | 3/1968 | White | 215/366 |
| 3,392,823 | 7/1968 | Green et al. | 206/45.33 |
| 3,590,989 | 7/1971 | Wittwer | 215/6 |
| 3,747,830 | 7/1973 | Goldman | 206/45.34 |
| 3,811,565 | 5/1974 | Tancredi | 206/45.34 |
| 3,987,582 | 10/1976 | Williams | 446/268 |
| 4,358,013 | 11/1982 | Shebley | 206/45.34 |

*Primary Examiner*—Joseph Man-Fu Moy
*Assistant Examiner*—David T. Fidei
*Attorney, Agent, or Firm*—Ronald E. Barry

[57] ABSTRACT

A sealed message carrier for a message written on a piece of paper, including a container having a top and bottom, a teddy bear sealed in the container, a tubular message holder carried in arms of the teddy bear, an opening in the bottom of the container for inserting the message into the holder and a tape for sealing the opening after the message has been inserted therein.

5 Claims, 3 Drawing Figures

SEALED MESSAGE CARRIER

BACKGROUND OF THE INVENTION

A number of novel devices are being promoted for delivering personal messages such as congratulations, birthdays, anniversaries, etc. One of these devices is in the form of a sealed container wherein an animal such as a teddy bear is used to hold the message so that it is removed from the container with the animal. The message is normally prepared by the sender, placed in the bear's arms and the bear placed in the container and the container then sealed. The message is usually prepared at the point of purchase, placed in the container and sealed therein.

SUMMARY OF THE INVENTION

The message carrier according to the present invention provides the purchaser with the opportunity to purchase the sealed container and insert the personal message later. The message can be prepared after the can has been sealed and inserted into the bear's arms for delivery to the recepient. The bear is positioned in the container with a message holder supported in his arms and the can sealed. An opening is provided in the bottom of the container through which the message holder projects after the can is sealed. A message is prepared and rolled up and inserted into the holder and the holder pushed into the container. The opening in the bottom of the container is then closed.

IN THE DRAWINGS

DESCRIPTION OF THE INVENTION

Figure 3:
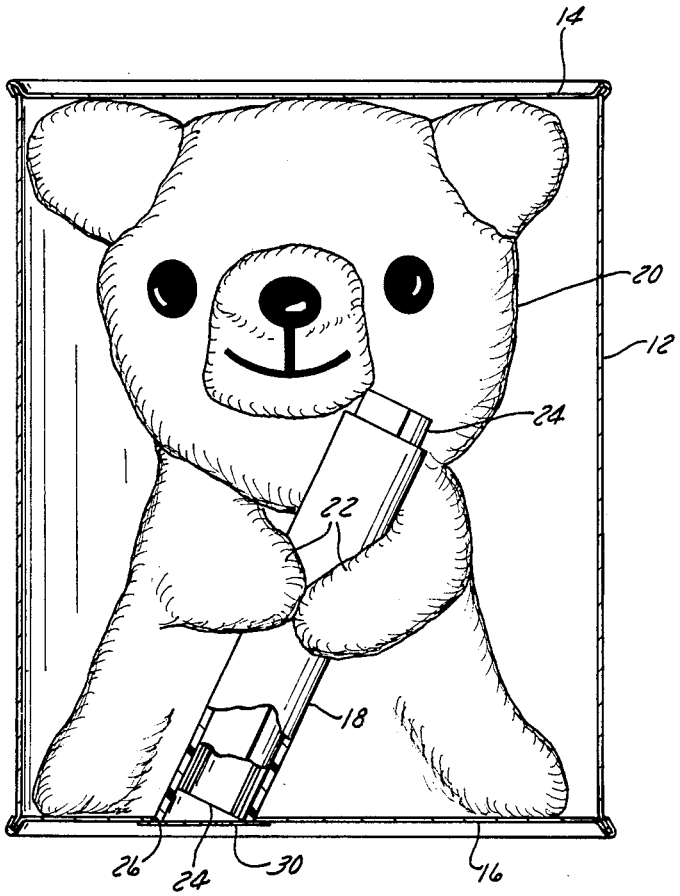
FIG. 3 is a section view partly broken away showing the teddy bear with the message holder and message in its arm.

Referring to the drawings the sealed message carrier generally includes a receptacle 10 in the form of a cylindrical container 12 having a top 14 and bottom 16. A message holder 18 in the form of a hollow tube is positioned in the container and supported therein by means of a stuffed doll or animal 20 having a pair of arms 22. The message 24 is written on a slip of paper which is sealed in the tube 18 as seen in FIG. 3. The message carrier is generally assembled with the animal 20 positioned in the container, the holder 18 positioned in the arms of the animal and the top and bottom sealed on the the container.

Figure 1:
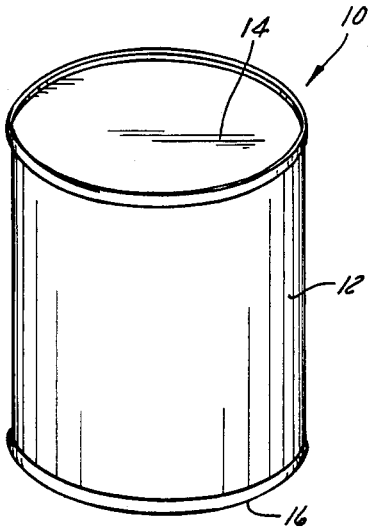
FIG. 1 is a perspective view of the message carrier according to the present invention.
Figure 2:
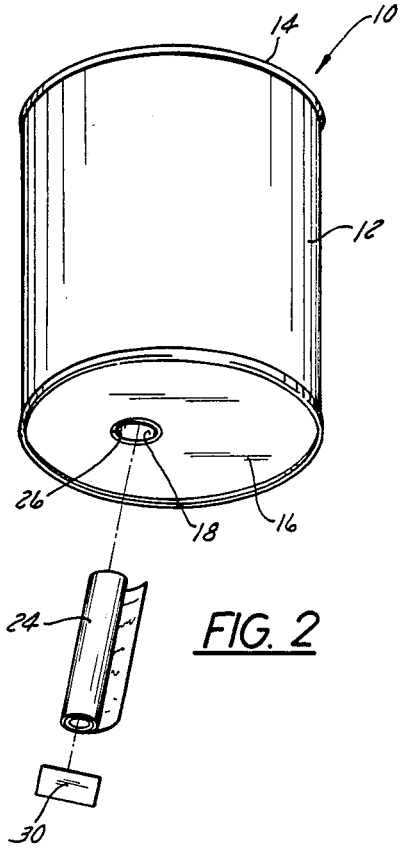
FIG. 2 is a perspective view showing the message and a tape aligned with the opening in the holder at the bottom of the container.

The message on the paper 24 is placed on the holder 18 by providing an opening 26 in the bottom of the container. Although a tape is shown, a plug or similar stopper could also be used. The tube 18 should be projecting slightly out of the opening in the bottom of the container as seen in FIG. 2. The paper 24 is rolled up and inserted in the tube 18, the tube is then pushed into the container. The opening is then sealed by means of a tape 30 secured to the bottom of the container or by inserting a resilient plug ingo the opening.

Means can be provided for covering the edges of opening 26 to prevent injury to the user. Such means can be in the form of a resilient ring which is inserted into the opening 26 to cover the edges of the opening. The ring can also be used to provide a seal by the engagement of the plug with the edges of the ring.

The embodiments of the invention in which an exclusive property or privilege is claimed, are defined as follows:

1. A message carrier comprising a container having a movable top and a bottom, said bottom have a small opening therein, a tubular message holder for holding a rolled up message, said holder being adapted to be inserted into said container through said opening in the bottom of the container means removably positioned in said container for holding the message holder on insertion through the opening on the bottom of the container, said holding means comprising a teddy bear having a pair of arms for supporting said holder, and means for sealing the opening in the bottom of the container whereby on removal of the top of the container the message holder will be carried by the holding means.

2. A sealed receptacle for delivering personal messages, said receptacle having a removable top and a bottom, said bottom including an opening, means for holding a message written on a slip of paper, means within said container for supporting said holding means on insertion through said opening into said container, said supporting means comprises a stuffed animal having a pair of arms arranged to suport said holding means within said receptacle means for sealing said opening whereby a message written on a piece of paper can be inserted into said holding means through said opening and said opening can be sealed by said sealing means.

3. The receptacle according to claim 2 wherein said holding means comprises a hollow tube.

4. The receptacle according to claim 2 wherein said supporting means is a teddy bear.

5. A sealed receptacle for delivering personal messages, said receptacle having a removable top and a bottom, said bottom including an opening, means for holding a message written on a slip of paper, means within said container for supporting said holding means on insertion through said opening into said container, said supporting means comprising a teddy bear having a pair of arms for supporting said holding means and a means for sealing said opening whereby a message written on a piece of paper can be inserted into said holding means through said opening and said opening can be sealed by said sealing means.

* * * * *